US005627519A

United States Patent [19]

Hatchimonji

[11] Patent Number: 5,627,519

[45] Date of Patent: May 6, 1997

[54] ACOUSTICAL ALARM STRONG BOX

[76] Inventor: Mike Hatchimonji, 7942 Barbi La., La Palma, Calif. 90623

[21] Appl. No.: 282,988

[22] Filed: Jul. 29, 1994

[51] Int. Cl.[6] ..... G08B 13/14

[52] U.S. Cl. ..... 340/568; 340/687; 340/693

[58] Field of Search ..... 340/568, 571, 340/693, 687, 529

[56] References Cited

U.S. PATENT DOCUMENTS

| | | | |
|---|---|---|---|
| 4,211,995 | 7/1980 | Smith | 340/571 X |
| 4,688,023 | 8/1987 | McGill et al. | 340/545 |
| 4,766,419 | 8/1988 | Hayward | 340/568 X |

*Primary Examiner*—Thomas Mullen

[57] ABSTRACT

A portable strong box device with a self contained acoustical alarm for protecting from theft valuables in the home, hotel room, motor vehicle or other locations where a suitable external electrical power source is available. The purpose of the external electrical power is to hold off the acoustical alarm until the external power is interrupted. Upon interruption of the external electrical power, the acoustical alarm, powered by a battery contained within the alarm system will be sounded. To further prevent any attempt to move the strong box from where it has been placed, a high strength cable is provided that may be wrapped around any convenient object that cannot be easily moved. As a portable device, easily carried in a suitcase for example, it does not require mounting by means of screws or bolts to an adjacent surface.

6 Claims, 2 Drawing Sheets

ACOUSTICAL ALARM STRONG BOX

BACKGROUND OF THE INVENTION

This invention relates to a device intended to prevent the theft of valuables from homes, hotel rooms, or motor vehicles by incorporating a loud acoustical alarm when the device is disconnected from an external electrical power source.

Theft of valuables from hotel rooms even when the guest is in the bathroom, from motor vehicles even though the doors had been locked, or even from one's own home is a source of concern which we all share. To discourage theft we resort to such tactics as hiding our valuables under the mattress in the hotel room or under the seat of the car in hopes that the thief will not look in these locations. For a knowledgeable thief few locations are secure.

In order to commit a theft, a thief needs to operate quickly and quietly. If the theft can be quietly as a "grab and run", the theft is likely to be successful. What the thief does not need is an impediment such as a loud noise making device triggered by the separation of the device from the external power source. It is unlikely that a thief would be so bold as to remain in the hotel room with the sound of the alarm filling the room or run down the hotel hallway carrying an object emitting a loud noise. In addition, a strong cable securing the device to a fixture in the room would serve to discourage the thief from even trying to run off with the strong box.

This apparatus is a strong box device that will provide protection of valuables such as money and jewelry in hotel rooms, motor vehicles, motor homes and in the home by means of a lockable container which is equipped with both an acoustical alarm and a high strength cable. The strong box device requires two sources of electrical power, an external power source such as a household electrical outlet or an automobile electrical system, and a battery within the alarm system. The household power will most likely require a voltage dropping transformer. The high strength cable is used to secure the container to any convenient object, such as a table or chair leg in a room or a gear shift lever in a motor vehicle, that cannot be easily moved.

While the thief may succeed in cutting or removing the cable, should the external power be interrupted, a switching means in the alarm circuit will activate the acoustical alarm.

The present is distinguished from prior art (U.S. Pat. No. : 4,688,023, Stephen T. McGill & Bette L. McGill; U.S. Pat. No. 4,691,195, Hesse L. Sigelman & Saul Medowik; U.S. Pat. No. 4,766,419, Gilbert O. Hayward; U.S. Pat. No. 4,855,715, Albert R. Sevigny & Robert Charbonneau; U.S. Pat. No. 4,872,210, Alexander Beneges) in that it is directed to the interruption of electrical power to activate the acoustical alarm.

U.S. Pat. No. 4,766,419 describes a recording device for the opening and closing of a closed member. The cable described in the apparatus functions much like sealing wire used in freight shipments.

U.S. Pat. No. 3,625,031, describes a flexible, elongated cable locked to a portable article, the protected object, and which encircles an object not easily moved, the steering column. This description, however, resembles a not uncommon practice of people who secure with chains or cable and padlocks easily moved objects to immovable structures.

U.S. Pat. No. 4,688,023 is a storage container with a sliding cover which will sound an alarm should the cover be opened excessively. When the cover is withdrawn a specific distance a mechanical lever in contact with the underside of the cover becomes free to rotate and cause the closing of an electrical contact points which thereby causes the alarm to sound.

U.S. Pat. No. 4,211,995 is a device to prevent theft of automotive accessories such as radios and tape players. In this patent (Smith), the container is bolted or screwed to a surface in the automobile. It employs a loud audible alarm triggered when the container is removed, by unscrewing or unbolting from the automobile surface. To further discourage theft, a metal chain padlocked to the container and a electrically conducting wire loop with both encircling the steering column has been described. From the description given in the summary of the invention, the intent of the container is to protect "certain expensive electronic gear for automobiles, such as tape players and citizen band radios" by fitting the container around that electronic gear. The container is further described as having an opening to provide access to the knobs and meters of the protected gear.

The specific objective of this invention is to provide a traveler, tourist or home resident with a strong box which will furnish protection for valuables, such as cash and jewelry, by means of a loud acoustical alarm, powered by an enclosed battery, triggered when the external source of power has been interrupted. Interruption of the external source of power can be accomplished by pulling the external source power plug from the input jack in the strong box wall or disconnecting from the electrical outlet. In an automobile, disconnecting the battery power source will trigger the alarm. This strong box device does not require bolting or screwing to any surface or does it need custom fitting around the object it is protecting.

The external power aspect of this invention does not require any more wiring than to (a.) plug into an automobile battery, or (b.) plug into a household electrical outlet with a small voltage reducing transformer. The other end of the wiring would plug into a connector incorporated in the wall of the strong box.

DESCRIPTION OF THE DRAWINGS

FIG. 1 shows a container 1 with an attached hinged cover 2 and in which is contained a compartment 3 for the acoustical system. Attached to a wall of the container is a combined lock and alarm interlock 4. Incorporated into a wall of the container is an electrical connector 5 to input the external power through use of adapter 14. A high strength cable 6 is provided to secure the container to an immovable object. The length of the cable is adjusted and held in place by clamps 7, one of which is shown in break out, which are attached to wall of the container. The operation of the clamps will be well known to anyone having ordinary skill in the art. In the wall adjacent to the alarm emitting device is an array of apertures 8 to allow the audible alarm to be more clearly heard. FIG. 2 is an embodiment of the electrical circuit of the acoustical alarm system. External power is input through connector 5 to empower an alarm hold off relay 9. Normally closed switch 10 is held open by the hold off relay until the external power is interrupted. When the external power is interrupted, the relay is de-energized and the switch 10 is allowed to close, thereby activating the alarm. Power to generate an audible alarm 12 is provided by a battery 11 contained within the alarm compartment 3. An interlock switch 13, integrated into the cover lock 4, will provide the user of the device a means to disable the alarm. Switch 13 is shown closed.

FIG. 3 describes an external power adapter. Adapter 14 is a voltage reducing transformer which is plugged into a household electrical outlet. Connector 15 is matched with and plugs into connector 5.

Figure 1:
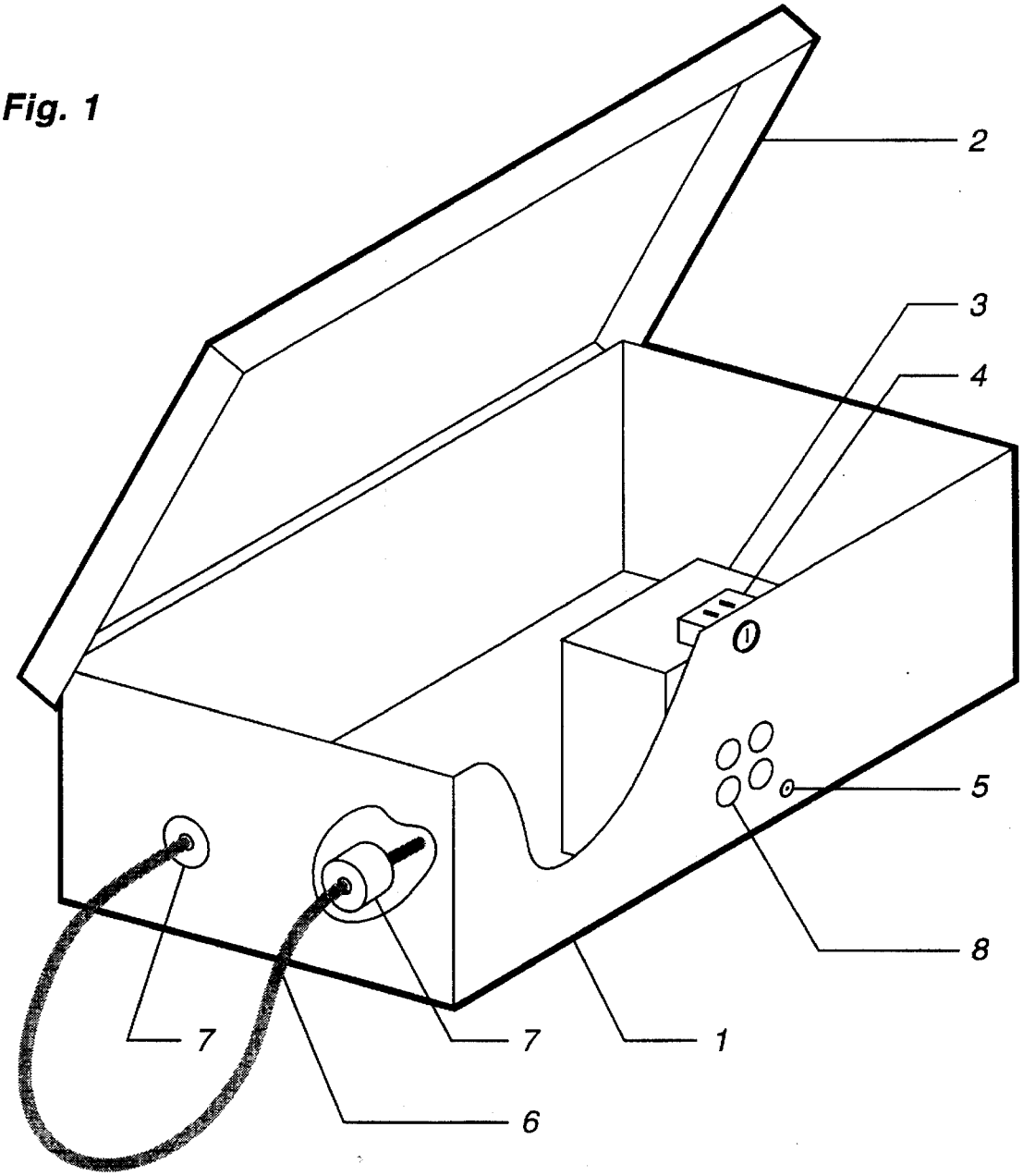
FIG. 1 is a perspective view of the acoustical alarm strong box.
Figure 2:
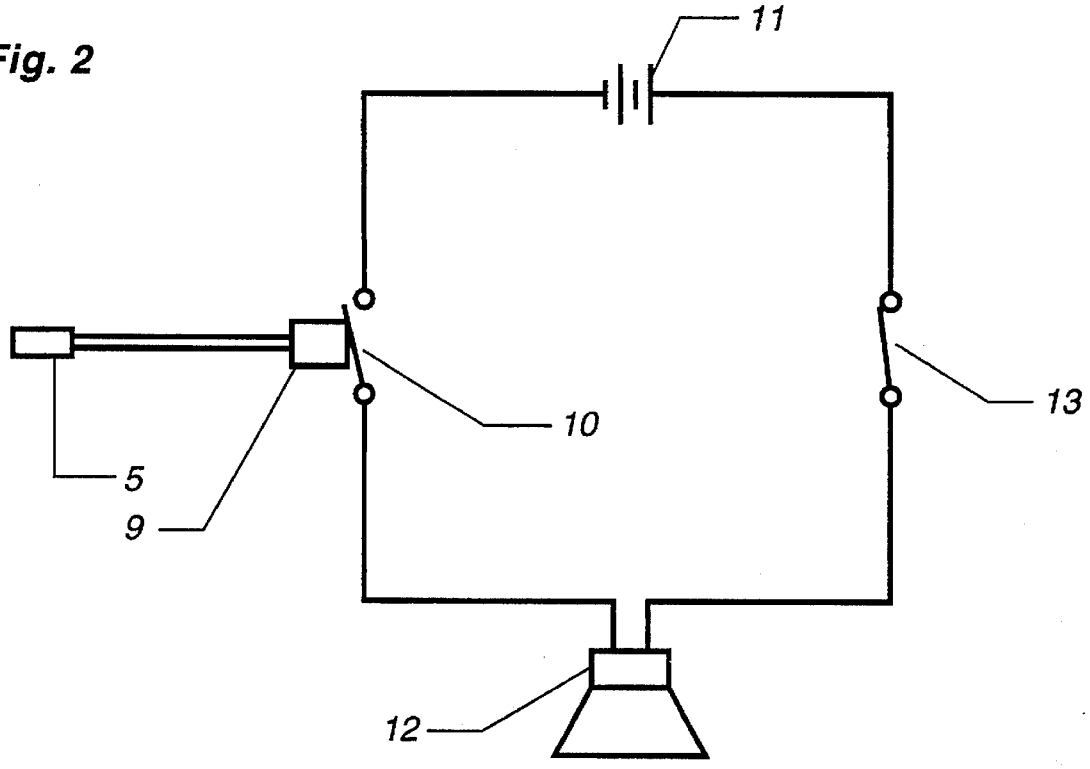
FIG. 2 is a diagram of the elements comprising the acoustical alarm system.
Figure 3:
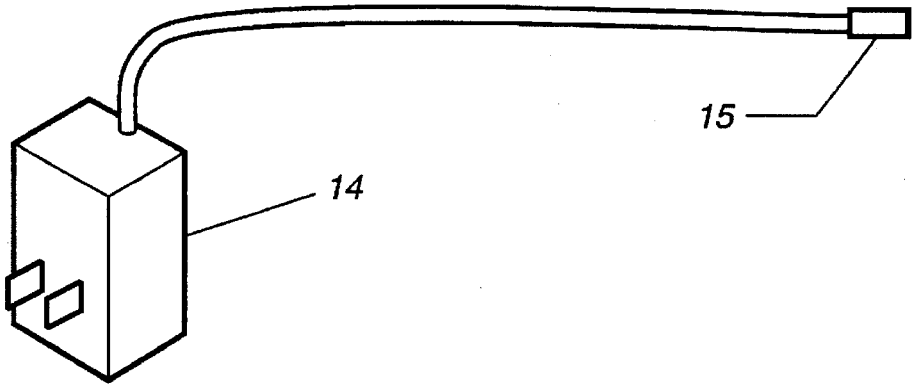
FIG. 3 describes an electrical connector used to provide the external power into the strong box.

It is envisioned that the preferred embodiment of this apparatus is a strong box container small enough to fit easily into the user's luggage.

While some preferred embodiments have been described in detail with reference to the accompanying figures, it will be understood that still further modifications and variations may be made within the spirit and scope of the invention as defined in the accompanying claims.

I claim:

1. An apparatus having a forced entry-resistant container for protecting valuables and an alarm device responsive to attempted theft of such valuables, the apparatus comprising:

a container in which valuables are placed;

a lock to prevent opening of the container;

a first external power source;

a self-contained second power source;

an alarm circuit including an acoustical alarm means incorporated within the container and responsive to disconnection of the first external power source from the container to emit an alarm;

a high strength cable secured within the container and forming a loop outside of the container to wrap around an immovable object; and an electrical interlock responsive to disengagement of the lock to disable the acoustical alarm means.

2. The apparatus of claim 1 wherein the container comprises a bottom, four upstanding walls and an attached and hinged lockable cover.

3. The apparatus of claim 8 wherein the first external power source comprises an external voltage reducing transformer for reducing the first external power source voltage when the electrical power is from a household electrical outlet.

4. The apparatus of claim 8 wherein the first external power source comprises a means for connecting the first external power source to the alarm circuit.

5. The apparatus of claim 4 comprising a means for activating the acoustical alarm means when the means for connecting is disconnected.

6. The apparatus of claim 1 wherein the self-contained second power source is an electrical storage device which comprises a battery.

* * * * *